United States Patent [19]

Boyd et al.

[11] Patent Number: 4,520,940

[45] Date of Patent: Jun. 4, 1985

[54] CONTAINERS FOR LIQUIDS

[75] Inventors: Malcolm W. Boyd, Walsall; Michael G. Mander, Wombourne, both of England

[73] Assignees: W. A. Goold Limited; W. J. Goodwin & Son Limited, both of Walsall, England

[21] Appl. No.: 626,288

[22] Filed: Jun. 29, 1984

[30] Foreign Application Priority Data

Jul. 2, 1983 [GB] United Kingdom ..... 8318007

[51] Int. Cl.[3] ..... B65D 6/34; B65D 8/04; B65D 8/06

[52] U.S. Cl. ..... 220/68; 220/375; 220/256

[58] Field of Search ..... 220/66, 68, 67, 256, 220/375; 222/566, 569, 570

[56] References Cited

U.S. PATENT DOCUMENTS 702,975 6/1902 Lisk ..... 220/68

3,549,042 12/1970 Stolle ..... 220/68

*Primary Examiner*—George T. Hall

*Attorney, Agent, or Firm*—Trexler, Bushnell & Wolters, Ltd.

[57] ABSTRACT

A flask, particularly for carrying alcoholic beverages, comprises a tubular body portion, having a seamless continuous internal surface, with respective inner end members fitted in the body portion to close the ends thereof and respective outer end members secured by soldering to the body portion at the ends thereof to define respective chambers between the inner and outer end members. The solder of the joints is out of contact with the interior of the flask, and any excess solder is received in the chamber, so that in use, liquid in the flask cannot become contaminated by contact with solder. A filling and pouring spout is secured to the inner and outer end members at one end of the flask.

22 Claims, 5 Drawing Figures

CONTAINERS FOR LIQUIDS

This invention relates to containers for liquids, particularly in the form of flasks generally known as 'hip' flasks, which are usually of broad flattened form to fit a pocket and are used especially to carry alcoholic beverages.

A problem with such flasks known at present is that the upper and lower metallic ends of the flask are secured to the metallic body thereof, to close its opposite ends, by soldering. In addition the body usually has a soldered join or seam extending along its length where the body assembly is completed. Liquid within the flask can come into contact with this solder and over a period of time it is considered that the liquid could become contaminated by such contact.

It is therefore an object of the invention to minimise or overcome this problem.

According to the invention a method of producing a container comprises providing an open ended tubular body portion having a seamless, continuous internal surface, closing the ends of said body portion by inserting respective inner end members into said ends so as to engage with the internal surface of the body portion, and securing by soldering or the like respective outer end members at the ends of the body portion at positions spaced from the inner end members to provide respective chambers, the solder or the like being out of contact with the interior of the container, and any excess solder being received in said chambers, with a filling and pouring spout being secured to inner and outer end members at one end of the body portion.

According to another aspect of the invention a container comprises a tubular body portion having a seamless, continuous internal surface, respective inner end members fitted in the body portion to close the ends thereof, respective outer end members being secured by soldering or the like to the body portion at the ends thereof to define respective chambers between them and the inner end members, the solder or the like being out of contact with the interior of the container, and a pouring and filling spout secured at one end of the container.

Figure 1:
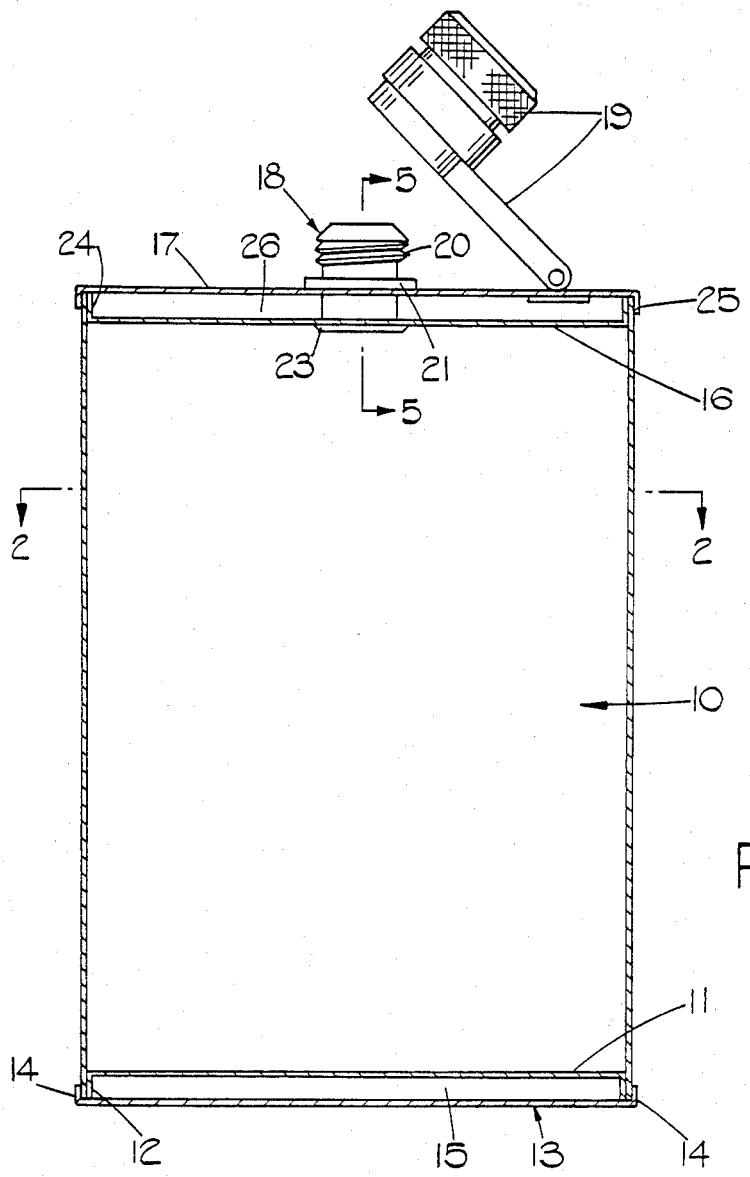
Figure 2:
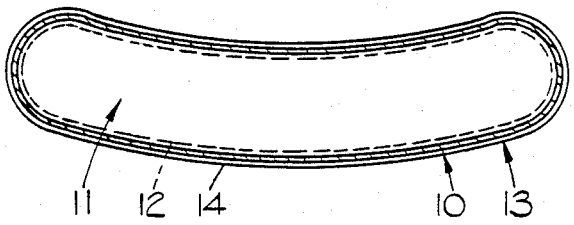
Figure 3:
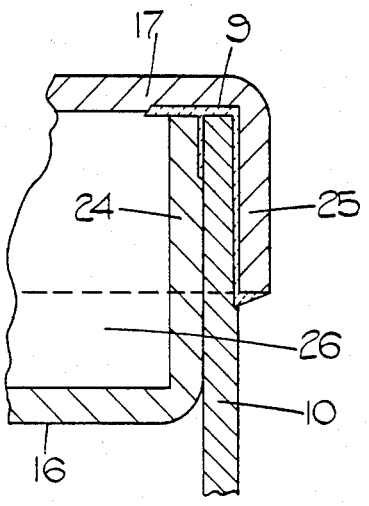
Figure 4:
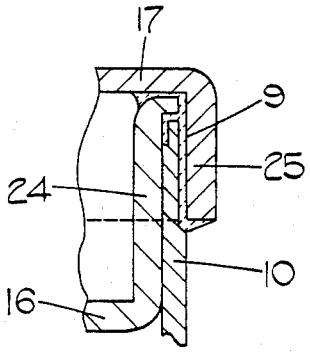
Figure 5:
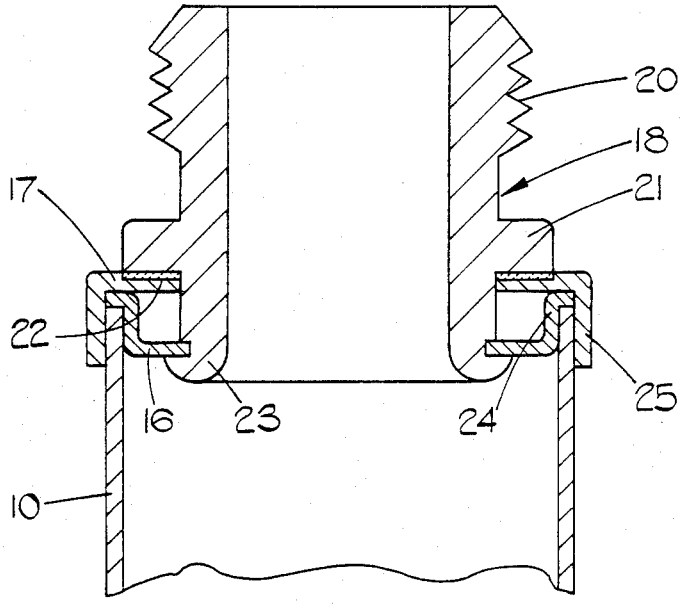

The invention will now be described, by way of example, with reference to the accompanying drawings, in which:

FIG. 1 is a part-sectional schematic view of a flask constructed in accordance with the present invention, FIG. 2 is a cross-sectional view on the line 2—2 of FIG. 1, FIG. 3 is an enlarged fragmentary section of the flask of FIG. 1, showing how inner and outer end members are assembled with a body portion of the flask, FIG. 4 is an alternative form of assembly from that shown in FIG. 3, and FIG. 5 is an enlarged, cross-sectional view on the line 5—5 of FIG. 1, showing how a spout of the flask is secured to the inner and outer end members, but showing the upper inner end member constructed as in FIG. 4.

The flask shown in FIG. 1 comprises a metallic tubular body portion 10, which on its exterior is normally covered with material such as leather to enhance the appearance of the flask. The tubular body portion is of conventional broad, generally flattened form and may be of generally rectangular transverse cross-section with rounded ends or alternatively may be generally curved, (FIG. 2) as required.

The tubular body portion 10 is of seamless construction and is conveniently produced by extrusion. The extruded body portion can be shaped by pressing to the required cross-section. Thus the internal surface of the tube is smooth and unbroken.

Fitted into the bottom end of the body portion 10 is an inner end member 11. This member 11 is in the form of a thin plate having a shape matching the internal cross-sectional shape of the body portion 10. Around its periphery the member 11 is provided with a downwardly directed flange 12. The end member 11, (FIGS. 1 and 2), is a tight force fit in the tubular body portion 10, with the external surface of the flange being tightly frictionally engaged against the interior surface of the body portion 10 so that it is retained in place therein. The member 11 is received into the body portion 10 a short way so that the free periphery of the flange is flush with the lower edge of the body portion 10.

Also disposed at the lower end of the body portion 10 is an outer end member 13. Like the end member 11, the outer end member 13 is also made of metal and is of generally plate-like form having a short upstanding flange 14. The outer end member 13 also matches the transverse cross-sectional shape of the body portion 10 but is slightly larger than the internal dimension thereof so that it can be engaged on the end of the body portion 10 in the form of a cap, with the flange 14 being engaged around the external surface of the body portion 10 as shown in FIGS. 1 and 2. Thus the flush surfaces of the end member 11 and body portion 10 abut against the outer end member 13, with a chamber 15 being defined between the inner end member 11 and the outer end member 13.

The outer end member 13 is secured to the body portion 10 by means of soldering. Solder 9 is arranged along the upwardly and inwardly facing surfaces of the flange 14, between the end of the body 10 and the flange 12 for a short distance, and also over the portion of the end member 13 against which the ends of the body portion 10 and inner member 11 abut. Any excess solder will be received within the chamber 15 and will be out of contact with the interior of the body portion 10 at the inner side of the end member 11. Furthermore this arrangement of inner and outer end members ensures that the ordinary solder joint at the end of the flask is not contacted by liquid contained in the flask, in use.

At the upper end of the flask, there is a further inner end member 16 and a further outer end member 17 of similar form to the members 11 and 13 at the bottom of the flask. The members 16 and 17 are however modified to mount a pouring and filling spout 18 as well as a pivotable closure cap 19.

FIG. 5 shows how the spout 18 is secured to the members 16 and 17. The spout is of generally hollow cylindrical form but has a portion near its upper end provided with screw threads 20. Below the screw threaded portion the spout is provided with an annular collar 21. The inner and outer members 16 and 17 are each provided with a circular hole of a diameter such that the spout is a force fit in the hole in the inner end member 16 and a clearance fit in the outer end member 17. As shown in FIG. 5, the outer end member 17 abuts the lower face of the collar 21. Preferably a small amount of flux paste containing a silver solder is provided between the outer end member and the lower face of the collar. This is indicated at 22 in FIG. 5. Application of heat to the area concerned will cause the flux paste to solidify, thus making the joint secure. Finally the lower end of the spout is spin rivetted over onto the underside of the inner end member 16, again as shown in FIG. 5, at 23.

The pivotable closure cap 19 is of conventional form, having internal screw threads to match the screw threads 20 on the spout so that the cap can be screwed down on to the spout to close the flask. The closure cap 19 is pivoted, in the conventional manner, on a lug upstanding from the underside of the outer end member 17.

As stated the further inner end member 16 is of similar form to the member 11 and is thus a tight-force fit in the body portion 10 in the same way as the member 11. The flange 24 of the member 16 tightly engages against the internal surface of the body portion 10. Similarly the flange 25 of the member 17 engages around the external surface of the body portion 10 with the outer end surfaces of the body portion 10 and member 16 abutting against the inwardly facing surface of the end member 17. This arrangement is shown in FIG. 3 in detail, being the same arrangement as for the lower end of the flask previously described. As mentioned before, solder 9 would be present along the, in this case, downwardly facing surface of the flange 25; between the inwardly facing surface of the flange 25 and the external surface of the body portion 10, between the top of the internal surface of the body portion 10 and the flange 24 for a short distance, and in addition solder would be present where the member 17 is abutted by the end surfaces of the body portion 10 and inner member 16. As with the end members 11 and 13, a chamber 26 is defined between the members 16 and 17 and again any excess solder at this upper joint between the members 16, 17 and body portion 10 would be received in this chamber 26. Again this soldering arrangement ensures that, in use, liquid in the interior of the flask would not come into any contact with the solder. Appropriate soldering can also be made on the outside of the flask if required, but naturally this cannot affect any liquid in the flask, in use.

Thus it can be appreciated that this construction of flask overcomes the problem mentioned in the introduction to the specification, namely that of liquid in the interior of the flask coming into contact with the solder material and being contaminated.

Instead of the arrangement shown in FIG. 3, the free end of the flange of the further inner end member 16 could preferably be turned over at right angles thereto as shown in FIG. 4 so that it is engaged between the inner corner of the further outer end member 17 and the top peripheral end surface of the body portion 10. However, as shown, solder 9 would still be present along the inwardly facing surface of the flange 25 as well as along the portion of the outer end member 17 which is abutted by the turned over part of the flange 24. In a similar manner the flange 12 of the inner end member 11 at the bottom of the flask could be arranged as in FIG. 4. The turned over part prevents any possibility of the inner end member slipping into the flask body.

Although soldering would normally be used, the invention also encompasses in its scope brazing and welding if appropriate.

We claim:

1. A container comprising a tubular body portion having a seamless, continuous internal surface, respective inner end members fitted in the body portion to close the ends thereof, respective outer end members being secured by soldering or the like to the body portion at the ends thereof to define respective chambers between them and the inner end members, the solder or the like being out of contact with the interior of the container, and a pouring and filling spout secured at one end of the container.

2. A container as claimed in claim 1, wherein the inner end members are force fitted or friction fitted in the body portion.

3. A container as claimed in claim 1 or claim 2, wherein each inner end member and each outer end member is of plate like form matching the interior and exterior cross-sectional shapes respectively of the tubular body portion, and includes a peripheral flange.

4. A container as claimed in claim 3, wherein the flange on the inner end member is generally perpendicular to the remainder of thereof, but has its free end turned through a right angle to overlie the end surface of the body portion, the outer end member engaging over said free end, with its own flange extending along the outer surface of the body portion thereby to close the end thereof, with there being a soldered joint between inwardly facing surfaces of the outer end member and respective parts of the body portion and inner end member adjacent thereto.

5. A container as claimed in claim 4, wherein there is a further soldered joint between adjacent surfaces of the body portion and the flange of the inner end member, the joint however terminating short of the interior of the container.

6. A container as claimed in claim 3, wherein the flange on the inner end member is perpendicular to the remainder thereof and terminates level with the end surface of the body portion, the outer end member engaging over the end of said flange and the end surface of said body portion, with its own flange extending along the outer surface of the body portion thereby to close the end thereof, with there being a soldered joint between inwardly facing surfaces of the outer end member and respective parts of the body portion and inner end member adjacent thereto.

7. A container as claimed in claim 6, wherein there is a further soldered joint between adjacent surfaces of the body portion and the flange of the inner end member, the joint however terminating short of the interior of the container.

8. A container as claimed in any one of the preceding claims, wherein the spout is of generally hollow cylindrical form but has an external collar engaging an outwardly facing surface of an outer end member, the part of the spout at one side of the collar extending through aligned holes in said outer end member and its associated adjacent inner end member and having its end shaped to engage the inner end member and prevent withdrawal of the spout outwardly of the container.

9. A container as claimed in claim 8, wherein the end is spin rivetted.

10. A container as claimed in claim 8 or claim 9, wherein said collar is secured to said outer surface of the outer end member.

11. A container as claimed in claim 10, wherein the securement is by flux paste containing silver solder.

12. A method of producing a container, comprising providing an open ended tubular body portion having a seamless, continuous internal surface, closing the ends of said body portion by inserting respective inner end members into said ends so as to engage with the internal surface of the body portion, and securing by soldering or the like respective outer end members at the ends of the body portion at positions spaced from the inner end members to provide respective chambers, the solder or the like being out of contact with the interior of the container, and any excess solder being received in said chambers, with a filling and pouring spout being secured to inner and outer end members at one end of the body portion.

13. A method as claimed in claim 12, wherein the inner end members are engaged as a force fit or a friction fit in the body portion.

14. A method as claimed in claim 12 or claim 13, wherein each inner end member and each outer end member is of plate like form matching the interior and exterior cross-sectional shapes respectively of the tubular body portion, and includes a peripheral flange.

15. A method as claimed in claim 14, comprising providing said flange on the inner end member with a first part perpendicular to the remainder thereof, and a second part turned through a right angle, engaging said inner end member in said tubular body portion until said second part engages the end surface of the body portion, providing said flange on the outer end member perpendicular to the remainder thereof, engaging said outer end member over the end of the body portion containing said inner end member with said outer end member extending over said second part of the inner end member flange, and with its flange extending along the outer surface of the body portion, and soldering inwardly facing surfaces of the outer end member to respective parts of the body portion and inner end member adjacent thereto.

16. A method as claimed in claim 15, comprising also soldering together adjacent surfaces of the body portion and the flange of the inner member, with the soldered joint terminating short of the interior of the container.

17. A method as claimed in claim 14, comprising providing the respective flanges on the inner and outer end members as perpendicular to the remainder thereof, engaging the inner end member in the body portion until its end surface is flush with the end surface of the body portion and fitting the outer end member over the end of the body portion with it engaging over the respective end surfaces of the flanges of the inner end member and the body portion, with its flange extending along the outer surface of the body portion, and soldering inwardly facing surfaces of the outer end member to respective parts of the body portion and inner end member adjacent thereto.

18. A method as claimed in claim 17, comprising also soldering together adjacent surfaces of the body portion and the flange of the inner member, with the soldered joint terminating short of the interior of the container.

19. A method as claimed in any one of claims 12 to 18, comprising providing a pair of aligned holes in adjacent inner and outer end members, inserting said pouring and filling spout through said holes until an external collar thereon engages the outwardly facing surface of the outer end member, and shaping the end of the spout disposed inside the container to prevent withdrawal of the spout from the container.

20. A method as claimed in claim 19, comprising shaping the end by spin rivetting.

21. A method as claimed in claim 19 or claim 20, comprising disposing securing material between the collar and said outwardly facing surface of the outer end member.

22. A method as claimed in claim 21, wherein the material applied is flux plaste containing silver solder and heat is applied to the area concerned to cause the paste to harden and form a secure joint.

* * * * *